US012023552B2

(12) United States Patent
Shinohara

(10) Patent No.: US 12,023,552 B2
(45) **Date of Patent: *Jul. 2, 2024**

(54) GOLF BALL AND RESIN COMPOSITION FOR COVER OR TOPCOAT THEREFOR

(71) Applicant: BRIDGESTONE SPORTS CO., LTD., Tokyo (JP)

(72) Inventor: Hirotaka Shinohara, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/494,203

(22) Filed: Oct. 5, 2021

(65) Prior Publication Data

US 2022/0193499 A1 Jun. 23, 2022

(30) Foreign Application Priority Data

Dec. 22, 2020 (JP) ..... 2020-212551

(51) Int. Cl.
*A63B 37/06* (2006.01)
*A63B 37/00* (2006.01)

(52) U.S. Cl.
CPC .. *A63B 37/00221* (2020.08); *A63B 37/00223* (2020.08); *A63B 37/0027* (2013.01); *A63B 2225/76* (2020.08)

(58) Field of Classification Search
CPC ..... A63B 37/0022; A63B 37/0023
USPC ..... 473/378
See application file for complete search history.

(56) References Cited

U.S. PATENT DOCUMENTS

| | | | | |
|---|---|---|---|---|
| 5,840,788 | A * | 11/1998 | Lutz | C08K 5/005 524/100 |
| 2006/0089419 | A1* | 4/2006 | Hogge | C09D 175/16 522/174 |
| 2010/0261550 | A1 | 10/2010 | Nagasawa et al. | |
| 2010/0261554 | A1 | 10/2010 | Nagasawa et al. | |
| 2011/0070975 | A1 | 3/2011 | Nagasawa et al. | |
| 2011/0070976 | A1* | 3/2011 | Nagasawa | A63B 43/008 473/378 |
| 2011/0070977 | A1 | 3/2011 | Nagasawa et al. | |
| 2020/0216686 | A1* | 7/2020 | Kim | A63B 37/00221 |
| 2021/0095059 | A1* | 4/2021 | Khavari | B33Y 70/00 |

FOREIGN PATENT DOCUMENTS

| | | | |
|---|---|---|---|
| JP | 08-318186 | A | 12/1996 |
| JP | 2000-516521 | A | 12/2000 |
| JP | 2010-246642 | A | 11/2010 |

* cited by examiner

*Primary Examiner* — Raeann Gorden
(74) *Attorney, Agent, or Firm* — Sughrue Mion, PLLC

(57) ABSTRACT

Provided are a golf ball which has a surface that sparkles when exposed to ultraviolet rays even if a naturally derived substance is used as a fluorescent material, and it is environmentally and human friendly, and a resin composition for a cover or a topcoat therefor. A resin composition for a cover or a topcoat of a golf ball of the present invention includes: a resin for a cover or a topcoat; and a plant-derived or alga-derived extract which emits light using an absorbed light as an energy source, as a fluorescent material. In the golf ball of the present invention, the cover or the topcoat is formed by using such a resin composition.

4 Claims, No Drawings

GOLF BALL AND RESIN COMPOSITION FOR COVER OR TOPCOAT THEREFOR

CROSS-REFERENCE TO RELATED APPLICATION

This application claims priority from Japanese Patent Application No. 2020-212551 filed Dec. 22, 2020, which is incorporated herein by reference in its entirety.

BACKGROUND OF THE INVENTION

The present invention relates to a golf ball and relates to a resin composition for a cover or a topcoat therefor, and in particular, relates to a golf ball and relates to a resin composition for a cover or a topcoat therefor which contains an improved fluorescent whitening agent (or fluorescent material).

Various golf balls have been marketed, such as golf balls with colorful appearances or color patterns, but common golf balls have a white background surface on which a golf ball manufacturer name, a brand name, a logo, or a symbol such as a number is provided. White golf balls are usually produced by forming a cover with dimples by using a resin containing a white pigment, and then forming a colorless transparent topcoat on the surface of the cover.

The resin for the cover of the golf ball may easily yellow when exposed to sunlight. In order to prevent such yellowing, the cover or the topcoat thereon may contain an ultraviolet absorber which absorbs ultraviolet rays in sunlight, or it may contain a fluorescent whitening agent which absorbs ultraviolet rays and emits visible rays having predetermined wavelengths in order to make the color look more distinctively white.

For example, JP 2000-516521 A discloses coumarin, oxazinone, stillbene, a napthalic compound, pyrazoline, and derivatives thereof as an optical whitening agent which absorbs UV light and emits visible light, in order to improve the visibility and appearance of a ball. As optical whitening agents, a stilbene derivative, a styryl derivative of benzene, biphenyl, a bis(benzazol-2-yl) derivative, coumarin, carbostyril, naphthalimide, a derivative of dibenzothiophene-5,5-dioxide, a pyrene derivative, and pyridotriazoles are disclosed to be conventionally used.

JP 2010-246642 A relates to a color golf ball and discloses that examples of the type of a fluorescent pigment blended in a cover include an organic fluorescent pigment obtained by the coloration of an amino base material resin or acrylic base material resin with a dye selected from the group consisting of a xanthene (red or pink) dye, an acridine (yellow) dye, a quinoline (yellow) dye, a thiazole (yellow) dye, and an aminoketone (yellow) dye.

JP H08-318186 A discloses a method for measuring a thickness of a coating film on the surface of a golf ball by utilizing a fluorescent whitening agent blended in the coating film, in which a CCD camera detects secondary emission rays, which are emitted by the golf ball when it is irradiated with ultraviolet light, and then a contrast image of the coating film is obtained by image-processing to determine the thickness of the coating film based on the obtained contrast.

SUMMARY OF THE INVENTION

Any of the optical whitening agent (or fluorescent dye) and the fluorescent pigment used for the golf ball are petroleum-derived chemical substances also including materials described in the above-described literature, and naturally derived substances are desired in consideration of depletion of fossil fuels and in consideration of the human body and the environment. Gypsum, fluorite, and calcite and the like which are mineral-derived pigments have been known to emit fluorescent light, and they may be able to be used as an inorganic fluorescent pigment. As described in JP 2010-246642 A, the inorganic fluorescent pigment can be used for coloring the cover of the golf ball, but the inorganic fluorescent pigment poorly dissolves in golf ball coating material, which is an organic material, whereby the inorganic fluorescent pigment causes loss of transparency and deteriorated abrasion property.

Therefore, the present invention has been made in light of the above problems, and an object of the present invention is to provide a golf ball which has a surface that sparkles when exposed to ultraviolet rays even if a naturally derived substance is used as a fluorescent material, and it is environmentally and human friendly, and a resin composition for a cover or a topcoat therefor.

In order to achieve the above object, according to an aspect of the present invention, a golf ball includes a core, a cover, and a topcoat, wherein the cover or the topcoat includes a plant-derived or alga-derived extract which emits light using absorbed light as an energy source.

The plant-derived or alga-derived extract may include curcumin, ferulic acid, a ferulic acid compound, spirulina, anthocyanin, quinine, phycocyanin, chlorophyll, or a combination thereof.

The plant-derived or alga-derived extract may have an absorbance peak at a wavelength of 350 nm to 450 nm.

When the topcoat may include the plant-derived or alga-derived extract, the topcoat may further include an oil-based coating material.

According to another aspect of the present invention, a resin composition for a cover or a topcoat of a golf ball includes: a resin for a cover or a topcoat of the golf ball; and a plant-derived or alga-derived extract which emits light using an absorbed light as an energy source.

The resin for a topcoat may include a urethane coating material containing a main agent and a curing agent, and a content of the plant-derived or alga-derived extract may be in a range of 0.01 to 5.0% by mass with respect to a total amount of the main agent inclusive of a solvent.

The solvent may include an ester solvent or a ketone solvent.

According to the present invention, the plant-derived or alga-derived extract which emits light using an absorbed light as an energy source is blended in the resin composition for a cover or a topcoat of a golf ball, whereby the cover or the topcoat of the golf ball can sparkle when exposed to ultraviolet rays. This makes it possible to provide a golf ball which uses a naturally derived substance as the fluorescent material, and it is environmentally and human friendly. The plant-derived or alga-derived extract acts as the fluorescent material even in a golf ball film thickness measurement test by utilizing a fluorescent whitening agent, whereby the thickness of the cover or topcoat can be measured with high accuracy.

Furthermore, curcumin, spirulina, anthocyanin and the like, which are the plant-derived or alga-derived extract which emits light using an absorbed light as an energy source, can emit light without impairing the luster and color tone of the golf ball, and can be blended in the resin composition for a cover or a topcoat of the golf ball as an organic material. In particular, curcumin, a ferulic acid compound, spirulina, and chlorophyll are oil-soluble, and can be blended in the resin for a topcoat by using an oil-based coating material such as the coating material containing the main agent and the curing agent as the resin for a topcoat. By not using an aromatic solvent, which is not environmentally and human friendly, but instead using an ester solvent or a ketone solvent as a solvent for the resin for a topcoat, a golf ball which is more environmentally and human friendly can be provided.

DESCRIPTION OF PREFERRED EMBODIMENTS

Hereinafter, embodiments of a golf ball, and a resin composition for a cover or a topcoat therefor according to the present invention, will be described in detail.

The resin composition for a cover or a topcoat of the present embodiment contains a resin for a cover or a topcoat of a golf ball, and a plant-derived or alga-derived extract (also referred to as a "phytochemical") which emits light using an absorbed light as an energy source, as a fluorescent whitening agent (or fluorescent material).

As the resin for a cover, a thermoplastic polyurethane, an ionomer resin, or a mixture thereof can be used as a main component, but the resin for a cover is not limited thereto.

The structure of the thermoplastic polyurethane material is composed of a soft segment composed of a polymer polyol (polymeric glycol) and a chain extender and polyisocyanate constituting a hard segment. Here, the polymer polyol to be a raw material is not particularly limited, but it is preferably, in the present invention, a polyester-based polyol and a polyether-based polyol. Specific examples of the polyester-based polyol include adipate-based polyols such as polyethylene adipate glycol, polypropylene adipate glycol, polybutadiene adipate glycol, and polyhexamethylene adipate glycol; and lactone-based polyols such as polycaprolactone polyol. Examples of the polyether polyol include poly(ethylene glycol), poly(propylene glycol), and poly(tetramethylene glycol).

The chain extender is not particularly limited, but in the present invention, it is possible to use, as the chain extender, a low molecular weight compound having two or more active hydrogen atoms which can react with isocyanate groups in the molecule thereof, and having a molecular weight of 2,000 or less. In particular, an aliphatic diol having 2 to 12 carbon atoms is preferable. Specific examples of the chain extender include 1,4-butylene glycol, 1,2-ethylene glycol, 1,3-butanediol, 1,6-hexanediol, and 2,2-dimethyl-1,3-propanediol. In particular, 1,4-butylene glycol is preferable.

The polyisocyanate compound is not particularly limited, but in the present invention, for example, it is possible to use one or two or more selected from the group consisting of 4,4'-diphenylmethane diisocyanate, 2,4-toluene diisocyanate, 2,6-toluene diisocyanate, p-phenylene diisocyanate, xylylene diisocyanate, naphthylene 1,5-diisocyanate, tetramethylxylene diisocyanate, hydrogenated xylylene diisocyanate, dicyclohexylmethane diisocyanate, tetramethylene diisocyanate, hexamethylene diisocyanate, isophorone diisocyanate, norbornene diisocyanate, trimethylhexamethylene diisocyanate, and dimeric acid diisocyanate. However, some isocyanate species make it difficult to control the cross-linking reaction during injection molding. Accordingly, in the present invention, 4,4'-diphenylmethane diisocyanate, which is an aromatic diisocyanate is preferable from the viewpoint of the balance between the stability during production and the developed physical properties.

As the ionomer resin, it is possible to use a resin containing, as a base resin, the following (a) component and/or the following (b) component, but the ionomer resin is not limited thereto. To the base resin, the following (c) component can be optionally added. The (a) component is a ternary random olefin-unsaturated carboxylic acid-unsaturated carboxylic acid ester copolymer and/or a metal salt thereof; the (b) component is an olefin-unsaturated carboxylic acid binary random copolymer and/or a metal salt thereof; and the (c) component is a thermoplastic block copolymer having a crystalline polyolefin block, and polyethylene/butylene random copolymer.

In the resin for cover, in addition to the main component of the above thermoplastic polyurethane or ionomer resin, thermoplastic resins or elastomers other than the thermoplastic polyurethane can be blended. Specifically, it is possible to use one or two or more selected from a polyester elastomer, a polyamide elastomer, an ionomer resin, a styrene block elastomer, a hydrogenated styrene butadiene rubber, a styrene-ethylene/butylene-ethylene block copolymer or a modified product thereof, an ethylene-ethylene/butylene-ethylene block copolymer or a modified product thereof, a styrene-ethylene/butylene-styrene block copolymer or a modified product thereof, an ABS resin, polyacetal, polyethylene and a nylon resin. In particular, for example, because the resilience and the abrasion resistance are improved due to the reaction with the isocyanate group while the productivity is satisfactorily maintained, it is suitable to adopt a polyester elastomer, a polyamide elastomer, and polyacetal. When the above components are blended, the blending amounts thereof are appropriately selected, without being particularly limited, according to the regulation of the hardness, the improvement of the resilience, the improvement of the fluidity, and the improvement of the adhesiveness and the like of the cover material. However, the blending amounts of the above components can be preferably set to be 5 parts by mass or more with respect to 100 parts by mass of the thermoplastic polyurethane component. The upper limit of the blending amount is also not particularly limited, but can be set to be preferably 100 parts by mass or less, more preferably 75 parts by mass or less, and still more preferably 50 parts by mass or less, with respect to 100 parts by mass of the thermoplastic polyurethane component. In addition, polyisocyanate compounds, fatty acids or derivatives thereof, basic inorganic metal compounds, and fillers and the like can be added.

As the resin for a topcoat, for example, coating material resins such as a urethane coating material composed of a polyol as a main agent and a polyisocyanate as a curing agent, and a rubber-based coating material can be used as a main component, but the resin for the topcoat is not particularly limited thereto. The coating material resins are oil-based coating materials containing organic solvents. The material for forming the topcoat may contain, as an additive, a low-surface energy composition such as a silicone wax in addition to the above main component. Hereinafter, the respective components will be described.

As the polyol, a polycarbonate polyol or a polyester polyol is preferably used, but the polyol is not limited thereto. Two types of polyester polyols, that is, a polyester polyol (A) and a polyester polyol (B) may also be used. It is suitable when these two types of polyester polyols are used, that the two types of polyester polyols are different in weight average molecular weight (Mw); the weight average molecular weight (Mw) of the (A) component is 20,000 to 30,000; and the weight average molecular weight (Mw) of the (B) component is 800 to 1,500. The weight average molecular weight (Mw) of the (A) component is more preferably 22,000 to 29,000, and still more preferably 23,000 to 28,000. The weight average molecular weight (Mw) of the (B) component is more preferably 900 to 1,200, and still more preferably 1,000 to 1,100.

The polyester polyol is obtained by the polycondensation between a polyol and a polybasic acid. Examples of the polyol include diols such as ethylene glycol, 1,2-propanediol, 1,3-propanediol, 1,3-butanediol, 1,4-butanediol, 1,6-hexanediol, neopentylglycol, diethylene glycol, dipropylene glycol, hexylene glycol, dimethylolheptane, polyethylene glycol, and polypropylene glycol; triols; tetraols, and polyols having an alicyclic structure. Examples of the polybasic acid include aliphatic dicarboxylic acids such as succinic acid, adipic acid, sebacic acid, azelaic acid, and dimer acid; aliphatic unsaturated dicarboxylic acids such as fumaric acid, maleic acid, itaconic acid, and citraconic acid; aromatic polybasic carboxylic acids such as phthalic acid, isophthalic acid, terephthalic acid, trimellitic acid, and pyromellitic acid; dicarboxylic acids having an alicyclic structure such as tetrahydrophthalic acid, hexahydrophthalic acid, 1,3-cyclohexanedicarboxylic acid, 1,4-cyclohexanedicarboxylic acid, and endomethylene tetrahydrophthalic acid; and tris-2-carboxyethyl isocyanurate. In particular, as the polyester polyol of the (A) component, polyester polyols having a cyclic structure introduced into the resin skeleton can be adopted. Examples of such a polyester polyol include a polyester polyol obtained by the polycondensation between a polyol having an alicyclic structure such as cyclohexane dimethanol and a polybasic acid, or a polyester polyol obtained by the polycondensation between a polyol having an alicyclic structure and diols or a triol and a polybasic acid. As the polyester polyol of the (B) component, a polyester polyol having a multibranched structure can be adopted. Examples of such a polyester polyol include polyester polyols having a branched structure such as "NIPPOLAN 800" manufactured by Tosoh Corporation.

When such a polyester polyol as described above is used, the weight average molecular weight (Mw) of the entirety of the main agent is preferably 13,000 to 23,000, and more preferably 15,000 to 22,000. The number average molecular weight (Mn) of the entirety of the main agent is preferably 1,100 to 2,000, and more preferably 1,300 to 1,850. When these average molecular weights (Mw and Mn) deviate from the above ranges, the abrasion resistance of the topcoat may be deteriorated. The weight average molecular weight (Mw) and the number average molecular weight (Mn) are measured values (polystyrene equivalent values) on the basis of gel permeation chromatography (hereinafter, abbreviated as GPC) measurement based on differential refractive index meter detection. Even when two types of polyester polyols are used, the Mw and Mn of the entirety of the main agent are within the above ranges.

The blending amounts of the above two types of polyester polyols (A) and (B) are not particularly limited, but the blending amount of the (A) component is preferably 20 to 30% by mass with respect to the total amount of the main agent inclusive of the solvent, and the blending amount of the (B) component is preferably 2 to 18% by mass with respect to the total amount of the main agent.

The polyisocyanate is not particularly limited, and it may be any of generally used aromatic, aliphatic, and alicyclic polyisocyanates and the like. Specific examples of such a polyisocyanate include trilene diisocyanate, diphenylmethane diisocyanate, xylylene diisocyanate, tetramethylene diisocyanate, hexamethylene diisocyanate, lysine diisocyanate, isophorone diisocyanate, 1,4-cyclohexylene diisocyanate, naphthalene diisocyanate, trimethylhexamethylene diisocyanate, dicyclohexylmethane diisocyanate, and 1-isocyanato-3,3,5-trimethyl-4-isocyanatomethylcyclohexane. These can each be used alone, or as mixtures of two or more thereof.

Examples of the modified product of the above hexamethylene diisocyanate include polyester-modified products and urethane-modified products of hexamethylene diisocyanate. Examples of the derivative of the above hexamethylene diisocyanate include nurates (isocyanurates), biurets and adducts of hexamethylene diisocyanate.

In the urethane coating material composed of a polyol and a polyisocyanate as the main component, the lower limit of the molar ratio (NCO group/OH group) between a hydroxyl group (OH group) belonging to the polyol and an isocyanate group (NCO group) belonging to the polyisocyanate is preferably 0.6 or more, and more preferably 0.65 or more. The upper limit of this molar ratio is preferably 1.5 or less, more preferably 1.0 or less, and still more preferably 0.9 or less. When this molar ratio is smaller than the above lower limit, unreacted hydroxyl groups remain, and performance and water resistance as a topcoat may be deteriorated. In addition, when this molar ratio is greater than the above upper limit, the isocyanate group is excessively present, whereby the reaction between the isocyanate group and the water content produces a urea group (fragile). Consequently, the performance of the topcoat may be deteriorated.

As a curing catalyst (organometallic compound) promoting reaction between the polyol and the polyisocyanate, an amine-based catalyst or an organometallic catalyst can be used. As the organometallic compounds, compounds conventionally blended as the curing agents of a two-component curing type urethane coating material such as metal soaps of aluminum, nickel, zin, and tin and the like can be suitably used.

The polyol as a main agent and the polyisocyanate as a curing agent can be mixed with various types of organic solvents according to coating conditions. Examples of such an organic solvent include aromatic solvents such as toluene, xylene, and ethyl benzene; ester solvents such as ethyl acetate, butyl acetate, propylene glycol methyl ether acetate, and propylene glycol methyl ether propionate; ketone solvents such as acetone, methyl ethyl ketone, methyl isobutyl ketone, and cyclohexanone; ether solvents such as diethylene glycol dimethyl ether, diethylene glycol diethyl ether, and dipropylene glycol dimethyl ether; alicyclic hydrocarbon solvents such as cyclohexane, methylcyclohexane, and ethylcyclohexane; and petroleum hydrocarbon solvents such as mineral spirits.

Among them, aromatic solvents such as toluene and xylene are not environmentally and human friendly, so that the ester solvent or the ketone solvent is preferably used. In particular, from the viewpoint of readily dissolving the plant-derived or alga-derived extract, the ester solvents such as butyl acetate and ethyl acetate are more preferable. In the plant-derived or alga-derived extract, curcumin and a ferulic acid compound and the like are oil-soluble, and are poorly soluble in water.

An aqueous solvent can also be used as the solvent. Examples of the aqueous solvent include water and aqueous alcohols. The aqueous solvent is more environmentally and human friendly than an organic solvent. The aqueous solvent and the organic solvent may be used in combination. For example, the aqueous solvent is used for the solvent for the main agent, and the organic solvent is used for the solvent for the curing agent. In the plant-derived or alga-derived extract, spirulina and chlorophyll and the like are water soluble, and the aqueous solvent can be used.

The fluorescent material used for the golf ball preferably has an absorbance peak at a wavelength of 350 nm to 450 nm. Examples of the plant-derived or alga-derived extract having an absorbance peak at such a wavelength include curcumin, ferulic acid, a ferulic acid compound, spirulina, anthocyanin, quinine, phycocyanin, and chlorophyll, but the plant-derived or alga-derived extract is not limited thereto. Such a plant-derived or alga-derived extract can absorb and emit light without impairing the luster and color tone of the golf ball.

Curcumin is extracted from turmeric and the like. Curcumin has an absorbance peak in a wavelength region of 350 to 450 nm.

The ferulic acid and the ferulic acid compound are contained in grains such as rice, wheat, rye, and barley, and seeds of coffee, apple, artichoke, peanut, orange, and pineapple and the like, and are mainly extracted from rice bran. The ferulic acid and the ferulic acid compound have an absorbance peak in a wavelength region of 320 to 360 nm. Examples of the ferulic acid compound include ferulic acid esters such as γ-orizanol.

Spirulina is the name of an alga which inhabits freshwater regions, and a powder obtained by dehydrating and drying the alga, followed by grinding, is also referred to as spirulina. Spirulina contains three kinds of dyes of carotenoid, chlorophyll, and phycocyanin. That is, spirulina contains these three kinds of alga-derived extracts. Spirulina has the three kinds of dyes, but has an absorbance peak in a wavelength region of 600 to 700 nm as a whole.

Anthocyanin is a dye which is widely present in the plant kingdom, and is, for example, extracted from fruits such as grape and blueberry. Anthocyanin has an absorbance peak in a wavelength region of 450 to 550 nm.

Quinine is extracted from cinchona bark, and has an absorbance peak in a wavelength region of 300 to 350 nm.

Phycocyanin is widely extracted from algae such as blue-green algae, gray algae, red algae, and cryptophytes in addition to the above-described spirulina. Phycocyanin has an absorbance peak in a wavelength region of 550 to 650 nm.

Chlorophyll is widely extracted from plant leaves in addition to the above-described algae such as spirulina. Chlorophyll has an absorbance peak in each of wavelength regions of 400 to 500 nm and 600 to 700 nm.

The plant-derived or alga-derived extract as the fluorescent material is preferably added for use to the main agent of the resin for topcoat in the case of the resin composition for topcoat. The blending amount of the plant-derived or alga-derived extract is set to be an amount sufficient to allow the golf ball to sparkle when exposed to ultraviolet rays. For example, the blending amount of the plant-derived or alga-derived extract is preferably 0.01% by mass or more, more preferably 0.1% by mass or more, still more preferably 0.5% by mass or more, and yet still more preferably 1.0% by mass or more, with respect to the total amount of the main agent inclusive of a solvent, but the blending amount of the plant-derived or alga-derived extract is not limited thereto. The upper limit of the blending amount of the plant-derived or alga-derived extract is, for example, preferably 5.0% by mass or less, more preferably 3.0% by mass or less, still more preferably 1.0% by mass or less, and yet still more preferably 0.5% by mass or less, but the upper limit of the blending amount is not limited thereto. This is because the increased blending amount of the plant-derived or alga-derived extract causes a change in the color tone of the golf ball; some plant-derived or alga-derived extracts have low solubility in a coating material; and the occurrence of insufficient dispersion of the plant-derived or alga-derived extract may have an influence on the appearance or abrasion property of the golf ball.

In the case of the resin composition for a cover, the blending amount of the plant-derived or alga-derived extract as the fluorescent material is, for example, preferably 0.5% by mass or more, and more preferably 5.0% by mass or less, with respect to the base material resin of the cover, but the blending amount of the plant-derived or alga-derived extract is not limited thereto.

In addition to the above components, white pigments, pearl pigments, and deglossing agents and the like may be added to the resin composition for a cover or a topcoat as necessary.

Next, an embodiment of a method for producing a golf ball by using the resin composition for a cover or a topcoat will be described.

The golf ball according to the present embodiment can adopt a multi-piece structure such as a two-piece structure constituted by a core and a cover or a three-piece structure constituted by a core, a cover, and an intermediate layer provided between the core and the cover.

The core can be formed mainly with a base material rubber. As the base material rubber, a wide variety of rubbers (thermosetting elastomers) can be used. For example, the following rubbers can be used: a polybutadiene rubber (BR), a styrene-butadiene rubber (SBR), a natural rubber (NR), a polyisoprene rubber (IR), a polyurethane rubber (PU), a butyl rubber (IIR), a vinyl polybutadiene rubber (VBR), an ethylene-propylene rubber (EPDM), a nitrile rubber (NBR), and a silicone rubber, but the base material rubber is not limited thereto. As the polybutadiene rubber (BR), for example, 1,2-polybutadiene and cis-1,4-polybutadiene and the like can be used.

To the core, in addition to the base material rubber to be a main component, for example, a co-cross-linking material, a cross-linking agent, a filler, an antiaging agent, an isomerization agent, a peptizer, sulfur, and an organosulfur compound can be optionally added. As the main component, in place of the base material rubber, a thermoplastic elastomer, an ionomer resin, or a mixture of these can also be used.

The core substantially has a spherical shape. The upper limit of the outer diameter of the core is preferably approximately 42 mm or less, more preferably approximately 41 mm or less, and still more preferably approximately 40 mm or less. The lower limit of the outer diameter of the core is preferably approximately 5 mm or more, more preferably approximately 15 mm or more, and most preferably approximately 25 mm or more. The core may be solid or hollow. The core may have a single layer, or may be a core composed of a plurality of layers such as the center core and a layer surrounding the core.

As the method for molding the core 10, it is possible to adopt a known method for molding a core of a golf ball. For example, a core can be obtained by kneading a material containing a base material rubber with a kneading machine, and by pressure vulcanization molding of the resulting kneaded product with a spherical mold, but the method is not limited thereto. As a method for molding a core having a plurality of layers, it is possible to adopt a known method for molding a solid core having a multilayer structure. For example, a multilayer core can be obtained as follows: a center core is obtained by kneading materials with a kneading machine, and by pressure vulcanization molding of the resulting kneaded product with a spherical mold; then materials for a surrounding layer are kneaded with a kneading machine, and the resulting kneaded product is molded into a sheet shape to obtain a sheet for the surrounding layer; the center core is covered with the sheet to prepare a covered center core; and the covered center core is then subjected to pressure vulcanization molding with the spherical mold to prepare the multilayer core.

Next, a cover is formed in the outer periphery of the core using a resin composition for a cover containing the plant-derived or alga-derived extract as the fluorescent material of the present embodiment. When a resin composition for a topcoat containing the plant-derived or alga-derived extract as the fluorescent material of the present embodiment is used in order to form a topcoat, a resin composition for a cover not containing the plant-derived or alga-derived extract as the fluorescent material is used in order to form the cover.

For a method for forming the cover, known golf ball cover molding methods can be adopted. The cover forming method is not particularly limited, but examples of the cover forming method include a method in which a core is disposed in a mold; and a resin composition for a cover is molded by injection molding, whereby and the cover can be formed so that it covers the core. The mold for molding the cover has a plurality of protrusions for forming dimples on the surface of the cover. The size, shape, and number and the like of the dimples formed on the surface of the cover can be appropriately designed according to the aerodynamic properties desired for the golf ball.

The lower limit of the thickness of the cover is preferably 0.2 mm or more, and more preferably 0.4 mm or more, and the upper limit thereof is preferably 4 mm or less, more preferably 3 mm or less, and still more preferably 2 mm or less, but the thickness of the cover is not limited thereto.

The upper limit of the material hardness of the cover in terms of Shore D is preferably approximately 60 or less, more preferably approximately 55 or less, and still more preferably approximately 50 or less, but the material hardness of the cover is not limited thereto. The lower limit of the material hardness of the cover in terms of Shore D is preferably approximately 35 or more, and more preferably approximately 40 or more. The resin material of the cover is formed into a sheet shape having a thickness of 2 mm, and the sheet is left for 2 weeks or more. Then, the material hardness of the cover as Shore D hardness is measured in conformity with the ASTM D2240-95 standard.

Furthermore, a topcoat (also referred to as "coating film") is formed in the outer periphery of the cover by using a resin composition for topcoat containing the plant-derived or alga-derived extract as the fluorescent material of the present embodiment. As described above, when the resin composition for a cover containing the plant-derived or alga-derived extract as the fluorescent material of the present embodiment is used in order to form the cover, a resin composition for a topcoat not containing the plant-derived or alga-derived extract as the fluorescent material is used in order to form the topcoat.

The thickness of the topcoat is not particularly limited, but the lower limit of the thickness of the topcoat is preferably 7 μm or more, more preferably 10 μm or more, and still more preferably 13 μm or more. The upper limit of the thickness is preferably 22 μm or less, and more preferably 20 μm or less.

The method for forming the topcoat on the surface of the cover is not particularly limited, and a known method for coating a golf ball coating material on the surface of the cover can be used. Methods such as an air gun coating method and an electrostatic coating method can be used.

The intermediate layer may be optionally provided between the core and the cover. The intermediate layer can be formed by using, as the material for the intermediate layer, the same materials as the abovementioned materials for the cover, that is, a thermoplastic polyurethane, an ionomer resin, or a mixture of these. Into the intermediate layer, in addition to the abovementioned main component, other thermoplastic elastomers, polyisocyanate compounds, fatty acids or the derivatives thereof, basic inorganic metal compounds, and fillers and the like can be added.

The lower limit of the material hardness of the intermediate layer is preferably 50 or more, and more preferably 55 or more, in terms of Shore D, but the material hardness of the intermediate layer is not limited thereto. The upper limit of the hardness of the intermediate layer 40 is preferably 70 or less, and more preferably 65 or less, in terms of Shore D.

The thickness of the intermediate layer is preferably 0.5 mm or more, and more preferably 1 mm or more, but the thickness of the intermediate layer is not limited thereto. The upper limit of the thickness of the intermediate layer is preferably 10 mm or less, and more preferably 5 mm or less.

This makes it possible to provide the golf ball including a cover or a topcoat containing the plant-derived or alga-derived extract as the fluorescent material.

EXAMPLES

Hereinafter, Examples of the present invention and Comparative Examples will be described.

Topcoats of golf balls were produced by using coating film blendings shown in Table 1. The blendings in Table 1 are in terms of parts by mass. The coating film thickness of the topcoat was set to be 15 μm. The produced golf balls were subjected to an appearance evaluation test due to ultraviolet irradiation.

As a polyol in a main agent in the coating film blending in Table 1, a polyester polyol having a weight average molecular weight (Mw) of 28,000 was used. This was synthesized by the following method. Into a reactor equipped with a reflux cooling tube, a dropping funnel, a gas introduction tube, and a thermometer, 140 parts by mass of trimethylolpropane, 95 parts by mass of ethylene glycol, 157 parts by mass of adipic acid, and 58 parts by mass of 1,4-cyclohexanedimethanol were charged. The resulting mixture was increased in temperature to 200 to 240° C. while stirring, and the mixture was heated (was allowed to react) for 5 hours. Then, a polyester polyol having an acid value of 4, a hydroxyl value of 170, and a weight average molecular weight (Mw) of 28,000 was obtained.

As the isocyanate of a curing agent, nurate (isocyanurate) of hexamethylene diisocyanate (HMDI) of Duranate TPA-100 (trade name) (NCO content: 23.1%, non-volatile content: 100%) manufactured by Asahi Kasei Corporation was used.

Hakkol 1800 of Table 1 as a fluorescent material is PY1800 (trade name) manufactured by Hakkol Chemical Co., Ltd. Turmeric Powder (trade name) sold by Ohtsuya Co., Ltd., was used for curcumin. A commercially available food dye (powder type) blue was used for spirulina. The fluorescent material was blended in the main agent. Butyl acetate and water were used as a solvent for the main agent and the curing agent. The dissolution of the fluorescent material in the solvent was observed and evaluated. An ultraviolet absorber dissolved without a precipitate remaining was evaluated as very good, and an ultraviolet absorber substantially dissolved although a precipitate was slightly observed was evaluated as good. The evaluation results of Examples and Comparative Examples are shown in Table 1.

Also in any of the golf balls, an ether-type thermoplastic polyurethane "PANDEX" (trade name) manufactured by DIC Covestro Polymer, Ltd. was used for the cover. The material hardness of the cover was 47 in terms of Shore D.

In any of the golf balls, the intermediate layer was composed of 35 parts by mass of Himilan 1706 (trade name), 15 parts by mass of Himilan 1557 (trade name) and 50 parts by mass of Himilan 1605 (trade name), each being an ionomer resin of an ethylene-methacrylic acid copolymer manufactured by Du Pont-Mitsui Polychemicals Co., Ltd., and 1.1 parts by mass of trimethylol propane.

In any of the golf balls, the core was composed of 20 parts by mass of a polybutadiene BR51 (trade name) manufactured by JSR Corporation and 80 parts by mass of a polybutadiene BR-01 (trade name) manufactured by JSR Corporation as a base material rubber; 28.5 parts by mass of zinc acrylate (manufactured by Wako Pure Chemical Industries, Ltd.); 1.0 part by mass of dicumyl peroxide (PERCUMYL D (trade name) manufactured by NOF Corporation) as an organic peroxide; 0.1 part by mass of 2,2-methylenebis(4-methyl-6-butylphenol) (Nocrac NS-6 (trade name)) manufactured by Ouchi Shinko Chemical Industrial Co., Ltd.) as an antiaging agent; 33.0 parts by mass of barium sulfate (Precipitated Barium Sulfate #100 (trade name) manufactured by Sakai Chemical Industry Co., Ltd.); 4.0 parts by mass of zinc oxide (Third Grade Zinc Oxide (trade name) manufactured by Sakai Chemical Industry Co., Ltd.); and 0.5 parts by mass of a pentachlorothiophenol zinc salt (manufactured by Wako Pure Chemical Industries, Ltd.) as an organosulfur compound.

Appearance Evaluation Test

The appearance of the golf ball when irradiated with ultraviolet rays (400 nm UV light) was visually observed, and the light emitting state thereof was evaluated. For the evaluation criteria, a case in which light emitting was remarkably observed was evaluated as very good; a case in which light emitting was sufficiently observed was evaluated as good; and a case in which light emitting was hardly observed was evaluated as poor. The evaluation results of Examples 1 to 5 and Comparative Examples 1 and 2 are shown in Table 1. The golf ball which is observed to emit light when irradiated with ultraviolet rays sufficiently emits light not only in fine weather, but also in cloudy weather when playing golf outdoors, and it has an excellent appearance. In addition, a golf ball which is not observed to emit light appears to be yellowish, in particular, in cloudy weather, and it has a poor appearance. In the golf ball which is observed to emit light, the thickness of the cover or the topcoat containing the fluorescent material can be measured with high accuracy also in a film thickness measurement test of a golf ball utilizing a fluorescent whitening agent. Therefore, the coating state of the coating film is also sufficiently observed, and a high-quality golf ball which has an even coating can be stably provided.

TABLE 1

| | | | Examples | | | | | Comparative Examples | |
|---|---|---|---|---|---|---|---|---|---|
| | | | 1 | 2 | 3 | 4 | 5 | 1 | 2 |
| Coating film blending | Main agent | Polyol | 27 | 27 | 27 | 27 | 27 | 27 | 27 |
| | | Butyl acetate | 73 | 73 | 73 | — | — | 73 | 73 |
| | | Water | — | — | — | 73 | 73 | — | — |
| | Curing agent | Isocyanate | 21 | 21 | 21 | 21 | 21 | 21 | 21 |
| | | Butyl acetate | 29 | 29 | 29 | 29 | 29 | 29 | 29 |
| | Fluorescent material | Hakkol 1800 | — | — | — | — | — | — | 0.5 |
| | | Curcumin | 0.05 | 0.1 | 0.3 | — | — | — | — |
| | | Spirulina | — | — | — | 1.0 | 3.0 | — | — |
| Coating film thickness [μm] | | | 15 | 15 | 15 | 15 | 15 | 15 | 15 |
| Evaluation of dissolution of fluorescent material | | | Very good | Very good | Good | Very good | Very good | — | Very good |
| Evaluation of appearance during ultraviolet irradiation | | | Good | Very good | Very good | Very good | Very good | Poor | Very good |

As shown in Table 1, in Comparative Example 1 which did not contain a fluorescent material at all, light emitting was hardly observed during ultraviolet irradiation. In addition, in Comparative Example 2 using petroleum-derived Hakkol 1800 as the fluorescent material, light emitting was remarkably observed in a small blending amount of 0.5 parts of mass.

In Examples 1 to 3 using curcumin, which is a plant-derived extract, light emitting was observed at any concentration during ultraviolet irradiation. In particular, as the blending amount of curcumin was increased, light emission was stronger, which could provide the same effect as that of a petroleum-derived fluorescent material, but when the blending amount of curcumin was too large, curcumin was found to incompletely dissolve in a solvent.

Also in Examples 4 and 5 using spirulina containing the alga-derived extract, light emitting was observed at any concentration during ultraviolet irradiation. In Examples 4 and 5, water was used as the solvent of the main agent, but an even topcoat could be formed as with Examples 1 to 3.

What is claimed is:

1. A golf ball comprising a core, a cover, and a topcoat, wherein the cover or the topcoat comprises a plant-derived or alga-derived extract which emits light using an absorbed light as an energy source, and wherein the plant-derived or alga-derived extract is curcumin, ferulic acid, a ferulic acid compound, spirulina, anthocyanin, phycocyanin, chlorophyll, or a combination thereof.

2. The golf ball according to claim 1, wherein the plant-derived or alga-derived extract has an absorbance peak at a wavelength of 350 nm to 450 nm.

3. The golf ball according to claim 1, wherein the topcoat comprises the plant-derived or alga-derived extract, and the topcoat further comprises an oil-based coating material.

4. The golf ball according to claim 3, wherein the plant-derived or alga-derived extract has an absorbance peak at a wavelength of 350 nm to 450 nm.

* * * * *